US009358822B2

(12) United States Patent
Faber

(10) Patent No.: US 9,358,822 B2
(45) Date of Patent: Jun. 7, 2016

(54) MOUNTING DEVICE FOR A STAMP PLATE

(71) Applicant: COLOP Stempelerzeugung Skopek Gesellschaft m.b.H. & Co. KG., Wels (AT)

(72) Inventor: Ernst Faber, Wels (AT)

(73) Assignee: COLOP Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 0 days.

(21) Appl. No.: 14/760,656

(22) PCT Filed: Jan. 21, 2014

(86) PCT No.: PCT/AT2014/050022

§ 371 (c)(1),
(2) Date: Jul. 13, 2015

(87) PCT Pub. No.: WO2014/113831

PCT Pub. Date: Jul. 31, 2014

(65) Prior Publication Data

US 2015/0352875 A1 Dec. 10, 2015

(30) Foreign Application Priority Data

Jan. 24, 2013 (AT) ..... 50054/2013

(51) Int. Cl.
*B41K 1/40* (2006.01)
*B41K 3/36* (2006.01)
(Continued)

(52) U.S. Cl.
CPC ... *B41K 3/36* (2013.01); *B41K 1/00* (2013.01); *B41K 1/006* (2013.01); *B41K 1/02* (2013.01);
(Continued)

(58) Field of Classification Search
CPC ..... B41K 1/006; B41K 1/02; B41K 1/36; B41K 1/40; B41K 1/42; B41K 1/54; B41K 1/00; B41K 1/38; B41K 3/36
USPC ..... 101/327, 333, 334
See application file for complete search history.

(56) References Cited

U.S. PATENT DOCUMENTS 3,063,371 A 11/1962 Lowell et al.
5,152,223 A 10/1992 Mairon
(Continued)

FOREIGN PATENT DOCUMENTS

AT 3176 U1 11/1999
AT 004 935 U1 1/2002
(Continued)

OTHER PUBLICATIONS

Anleitung zum Zusammensetzen der Stempel [Instruction for construction of the stamps] [online], [discovered on Nov. 29, 2013]. Discovered on the website: •URL:http//www.vistaprint.de/stempel-montage-anleitung.
aspx?GP=11%2f29%2f2013+5%3a29%3a37+Am
&GPS=3026443255&GNF=1•.
(Continued)

*Primary Examiner* — Blake A Tankersley
*Assistant Examiner* — Marissa Ferguson Samreth
(74) *Attorney, Agent, or Firm* — Collard & Roe, P.C.

(57) ABSTRACT

The invention relates to a mounting device (1) for connecting a stamp plate (7) to a stamp plate carrier (8) arranged, preferably in a movable manner, in a stamp housing (18), having a preferably plate-like base (2) and having at least one orienting element (4) arranged on a top side (3) of the base (2), the orienting element (4) delimiting a receiving region (5) for a stamp plate (7), the dimensions of which correspond approximately to those of an impression side (10) of the stamp plate carrier (8).

13 Claims, 6 Drawing Sheets

(51) Int. Cl.

| | |
|---|---|
| ***B41K 1/36*** | (2006.01) |
| ***B41K 1/42*** | (2006.01) |
| ***B41K 1/00*** | (2006.01) |
| ***B41K 1/54*** | (2006.01) |
| ***B41K 1/02*** | (2006.01) |
| ***B41K 1/38*** | (2006.01) |

(52) U.S. Cl.
CPC ... *B41K 1/36* (2013.01); *B41K 1/38* (2013.01); *B41K 1/40* (2013.01); *B41K 1/42* (2013.01); *B41K 1/54* (2013.01)

(56) References Cited

U.S. PATENT DOCUMENTS

| | | | | |
|---|---|---|---|---|
| 5,463,947 | A * | 11/1995 | Taira | B41N 1/24 101/125 |
| 5,505,130 | A * | 4/1996 | Winston | B41K 1/54 101/327 |
| 5,743,186 | A | 4/1998 | Liao | |
| 5,768,992 | A | 6/1998 | Daw et al. | |
| 5,816,160 | A * | 10/1998 | Taira | B41K 1/04 101/327 |
| 6,761,114 | B2 | 7/2004 | Koneczny et al. | |
| 7,066,089 | B1 * | 6/2006 | Shih | B41K 1/40 101/327 |
| 7,267,054 | B2 * | 9/2007 | Lien | B41K 1/46 101/327 |
| 7,389,727 | B2 | 6/2008 | Faber | |
| 7,464,643 | B2 | 12/2008 | Pointl | |
| 2001/0027612 | A1 * | 10/2001 | Barr | B25H 7/02 33/528 |
| 2004/0007144 | A1 | 1/2004 | Koneczny et al. | |
| 2004/0025727 | A1 | 2/2004 | Faber | |
| 2004/0035310 | A1 | 2/2004 | Zindl | |
| 2005/0056173 | A1 | 3/2005 | Dour | |
| 2005/0066828 | A1 | 3/2005 | Wei | |
| 2006/0000374 | A1 | 1/2006 | Faber | |
| 2006/0162596 | A1 | 7/2006 | Faber | |
| 2007/0169650 | A1 | 7/2007 | Shih | |
| 2009/0229482 | A1 | 9/2009 | Shih | |
| 2010/0170813 | A1 | 7/2010 | Faber | |
| 2010/0300314 | A1 * | 12/2010 | Chen | B41K 1/56 101/405 |
| 2011/0277647 | A1 | 11/2011 | Zindl et al. | |
| 2012/0297998 | A1 | 11/2012 | Zehetner et al. | |

FOREIGN PATENT DOCUMENTS

| | | | |
|---|---|---|---|
| AT | 6265 | U1 | 7/2003 |
| AT | 7861 | U1 | 10/2005 |
| AT | 507 692 | A1 | 7/2010 |
| AT | 507 833 | A2 | 8/2010 |
| AT | 414 342 | B | 9/2011 |
| AT | 511 453 | A4 | 12/2012 |
| DE | 634 393 | C | 8/1936 |
| DE | 32 00 551 | A1 | 7/1983 |
| DE | 69601069 | T2 | 6/1999 |
| EP | 0 803 372 | A1 | 10/1997 |
| EP | 0 807 531 | A1 | 11/1997 |
| EP | 1 280 669 | B1 | 2/2007 |
| EP | 1 603 754 | B1 | 8/2007 |
| EP | 1 603 755 | B1 | 8/2007 |
| FR | 2 127 114 | A5 | 10/1972 |
| WO | 01/83226 | A1 | 11/2001 |
| WO | 01/83227 | A1 | 11/2001 |
| WO | 2004/060685 | A1 | 7/2004 |
| WO | 2004/091923 | A1 | 10/2004 |
| WO | 2005/037565 | A1 | 4/2005 |
| WO | 2006/119597 | A2 | 11/2006 |

OTHER PUBLICATIONS

International Search Report of PCT/AT2014/050022, mailed Jun. 4, 2014.
International Search Report of PCT/AT2014/050023, mailed Jul. 16, 2014.
International Search Report of PCT/AT2014/050024, mailed Jul. 8, 2014.
International Search Report of PCT/AT2014/050025, mailed Aug. 11, 2014.
Austrian Office Action in A 50051/2013-1, dated Nov. 29, 2013, with an English translation of relevant parts.
Austrian Office Action in A 50052/2013-1, dated Nov. 29, 2013, with English translation of relevant parts.
Austrian Office Action in A 50053/2013-1, dated Nov. 29, 2013, with an English translation of relevant parts.
Austrian Office Action in A 50054/2013-1, dated Nov. 29, 2013, with an English translation of relevant parts.

* cited by examiner

MOUNTING DEVICE FOR A STAMP PLATE

CROSS REFERENCE TO RELATED APPLICATIONS

This application is the National Stage of PCT/AT2014/050022 filed on Jan. 21, 2014, which claims priority under 35 U.S.C. §119 of Austrian Application No. A 50054/2013 filed on Jan. 24, 2013, the disclosure of which is incorporated by reference. The international application under PCT article 21(2) was not published in English.

TECHNICAL FIELD

The invention relates to a mounting device for connecting a stamp plate to a stamp plate carrier arranged, preferably in a movable manner, in a stamp housing.

To produce stamps and stamp devices in an economical manner or make their mass production possible it is known to produce them without a stamp plate and to subsequently connect the stamp plate comprising the printing plate with a stamp plate carrier provided for this purpose in or on the stamp. For instance, the connection between the stamp plate and the stamp plate carrier may be an adhesive joint, and in most cases the individual stamp plate is connected manually to the stamp plate carrier. The orientation of the stamp plate on the stamp plate carrier is effected manually and roughly by eye. In particular, a turning of the stamp plate and/or a badly aligned arrangement may be caused, which later on will result, for instance, in oblique printing and/or a deterioration of the pressure distribution on the stamp plate and thus a worse printed image. However, once the stamp plate has been used and the error has occurred, correction of the orientation is not provided for, and in most cases is not possible or only possible with a great deal of effort.

PRIOR ART

The DE 32 00 551 A1 for example shows a stamp comprising an exchangeable stamp plate carrier. The stamp or pressure plate or the printing plate respectively is connected to the stamp plate carrier by means of adhesion or similar measures. How to effect such a connection is not described in detail, however.

Furthermore, the AT 507 692 A1 shows a special packaging of several stamps, which facilitates the free-hand adhesion of text plates.

In the AT 6265 U1 the orientation problem is avoided by means of guide structures in the form of engagement elements on the stamp plate and on the carrier.

Finally, the EP 0 807 531 A1 describes various manners of attaching a stamp plate to a carrier, in which connection the stamp plate is either received in rail-like guides on the carrier, locked in a recess or aligned by means of orienting holes in the stamp plate and corresponding pins on the carrier.

SUMMARY OF THE INVENTION

It is the object of the invention to create a mounting device which allows a stamp plate to be connected to a stamp plate carrier with optimum orientation of the stamp plate on the stamp plate carrier. The device should have a construction as simple as possible, and it should be inexpensive to produce and easy to operate.

According to the invention this object is achieved in that the mounting device comprises a preferably plate-shaped base comprising at least one orienting element arranged on a top side of the base, which orienting element delimits a receiving region for a stamp plate whose dimensions roughly correspond to those of the impression side of the stamp plate carrier. Accordingly, the mounting of the stamp plate can be effected by simply inserting the stamp plate in the receiving region and subsequently actuating the stamp above the stamp plate, i.e. onto its back side. With the help of the orienting element(s), first of all the stamp plate is aligned relative to the base in the delimited receiving region, and then also the stamp is aligned by the orienting elements) relative to the base. Thus, the base comprising the orienting elements primarily serves to bring the stamp and the stamp plate carrier in an exact adhesion position when adhering the stamp plate, that is to say the two parts aligned relative to the base are mutually aligned, thus making it possible to achieve an optimum connection between the stamp plate and the stamp plate carrier.

It has turned out to be favorable if the base comprises at least two, preferably four orienting elements for the stamp plate. Compared to a single, e.g. continuous orienting element, what is of advantage is that removing the stamp plate from the receiving region is facilitated, since the outer edge of the stamp plate is accessible and can be gripped via free areas or interruptions between the orienting elements. This is of particular advantage if a stamp plate was inserted inadvertently or a connection to the stamp plate carrier fails. The orientation of the stamp plate may be obtained by means of two or four orienting elements just as well as with a single one, three or more than four orienting elements; it only depends on the shape and arrangement of the orienting elements. Four orienting elements are suited especially for the usually rectangular shape of stamp plates, since these may be arranged e.g. in the area of the four corners and thus inserting and removing the stamp plate on the lateral edges is possible without any hindrance. In the case of a round stamp plate, e.g. two or three orienting elements may be provided.

To achieve an early orientation of the stamp when using the device, i.e. when mounting the stamp plate, it is favorable if the orienting elements are adapted to be higher than a stamp plate inserted in the receiving region. Accordingly, the stamp is aligned above the stamp plate, i.e. preferably (also) in that the outer sides of the orienting elements guide and align the inner side of the stamp housing; in the case of a stamp which was guided near the base inadvertently in an inaccurate way, a correction may be effected prior to a contact with the stamp plate. On the whole, this measure facilitates the orientation of the stamp.

In the case of a stamps comprising a housing surrounding the stamp plate carrier, it is of advantage if in a mounting position with a stamp, preferably a self-inking stamp, at least one orienting element is arranged at least partially between the stamp housing and the stamp plate carrier of the stamp. In the case of a movable stamp plate carrier, in particular one that is turned by 180°, the stamp housing can be aligned relative to the base and the inserted stamp plate. In the case of self-inking stamps, in which the placing of the stamp and the actuation of the stamp are usually different, subsequent operating actions, the housing can be aligned already during the placing of the housing. The orientation of the stamp plate carrier takes place automatically. In addition, the arrangement of the orienting element(s) between the stamp housing and the stamp plate carrier can serve a precise final orientation of the stamp plate in the stamp housing, which only by orienting elements arranged outside the housing could not be obtained in the same manner.

To facilitate the insertion of the stamp plate in the receiving region of the mounting device, it is favorable if the orienting elements have, on their inner side facing the receiving region, a partially bevelled plate guide surface in view of an otherwise perpendicular course relative to the top side of the base. Any inaccurate orientation is automatically corrected by such a bevel upon insertion of the stamp plate and the stamp plate is moved along the plate guide surface and into a correctly oriented position.

Similarly, it is favorable if the orienting elements have a housing guide surface extending partially upwards in a bevelled manner on their outer side facing away from the receiving region. Thus, upon placing on the stamp, i.e. the stamp housing, its orientation can, if necessary, be corrected by means of gliding along the housing guide surfaces, which facilitates and accelerates the use of the present mounting device.

In addition, centering elements for the stamp plate can be provided on the base adjacent to the receiving region. An even more accurate orientation of the stamp plate can be obtained by means of additional centering elements. In particular, in this case the orienting elements can be shaped such that they would allow a movement of the stamp plate in one direction, wherein only the centering elements prevent a movement in this open direction and achieve a completely fixed arrangement of the stamp plate in the plane of the receiving region. The centering elements can serve the orientation of the stamp plate, but also the (additional) orientation of the stamp plate carrier and/or a stamp housing.

In connection with the above cited centering elements it is favorable if the height of the centering elements is lower than the height of the orienting elements and preferably corresponds to about the thickness of a stamp plate. Due to the lower height the centering elements come into contact with the stamp housing during insertion of the stamp plate only after the orienting elements, so that the stamp plate is already oriented at least partially by the orienting elements. It is possible that the centering elements do not come into contact with the stamp plate carrier at all or only directly prior to its connection to the stamp plate.

To avoid collisions during turning or carrying off the stamp plate after mounting for certain stamp plate sizes, it is advantageous if the base comprises a recess in the receiving region, the depth of which roughly corresponds to the depth of a stamp relief of a stamp plate.

For an especially simple orientation, at least one outer stop or guiding element for the stamp housing, preferably at least two, in particular four guiding elements may possibly be arranged on the top side of the base outside the at least one orienting element and spaced apart therefrom. Said stop or guiding elements may be higher and broader than the orienting elements and be equipped with guidance surfaces bevelled towards the inside, the receiving region. In such a mounting device, it is sufficient if a stamp housing be oriented in a very rough manner upon moving the stamp housing towards the stamp plate, so that first the housing is aligned by the guiding elements and only then by the orienting elements.

BRIEF DESCRIPTION OF THE DRAWINGS

Below, the invention will be illustrated by way of particularly preferred embodiments, however, to which it shall not be limited, and will be further explained with reference to the drawings, in which in detail.

DETAILED DESCRIPTION OF THE DRAWINGS

Figure 1:
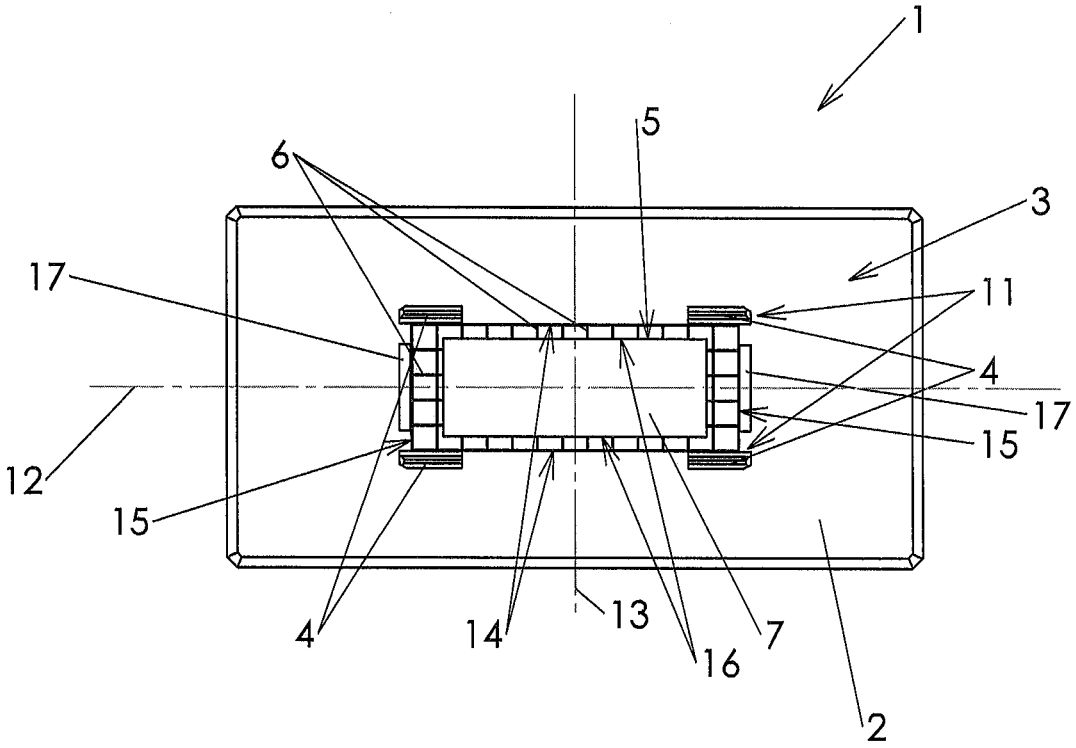
FIG. 1 shows a top view of a mounting device comprising a stamp plate.

FIGS. 1 and 2 show a mounting device 1 comprising a base 2. Four orienting elements 4 are arranged on a top side 3 of the base 2, which delimit a rectangular receiving region 5. The receiving region 5 is provided with orienting marks 6 in the form of a square grid of vertical and horizontal lines, whereby the lines can be differentiated by color from the remaining surface of the receiving region 5. A stamp plate 7 is arranged in the center of the receiving region 5, whose dimensions in the example shown in FIG. 1 are smaller than those of the receiving region 5, so that there is no contact between the stamp plate 7 and the orienting elements 4. The stamp plate 7 is oriented along the orienting marks 6. The arrangement of the stamp plate 7 to be mounted on a stamp plate carrier 8 (cf. FIG. 3) corresponds to an arrangement when producing a print with a stamp 9; in this case, an impression side 10 comprising a stamp relief or a printing plate would face downwards to the base 2.

The orienting elements 4, for instance, are each arranged in one of the four corners 11 of the rectangular receiving region 5 and thus delimit the receiving region 5. The orienting elements 4 are preferably arranged in a mirror-symmetrical manner with respect to both a central longitudinal axis 12 and a central transverse axis 13 of the receiving region 5. In particular, the longitudinal orienting elements 4 in the top view are arranged directly adjacent to the two longitudinal sides 14 of the receiving region 5 in parallel thereto, and in the plane of the receiving region 5 they slightly project beyond the short sides 15 of the receiving region 5. Accordingly, the shown orienting elements 4 for a stamp plate 7 only serve the orientation transversely to the longitudinal axis 12, that is if the stamp plate 7 is as large as the receiving region 5. A space is provided between the orienting elements 4 arranged on the longitudinal side 14 of the receiving region 5, which is sufficient to grasp an inserted stamp plate 7, for example, on its lengthwise edges 16 and remove it from the mounting device 1 with one's fingers.

The movement of the stamp plate 7 in longitudinal direction or along the longitudinal axis 12 is not prevented by the orienting elements 4 shown in this example. For this purpose, the mounting device 1 comprises smaller, i.e. lower centering elements 17, which are arranged directly adjacent to the shorter sides 15 of the receiving region 5 in parallel thereto and perpendicular to the orienting elements 4. The centering elements 17 prevent the stamp plate 7 from shifting along the longitudinal axis 12 beyond the shorter sides 15 of the receiving region 5. Stamp plates 7, whose dimensions approximately correspond to those of the receiving region 5, are held in a fixed, correctly oriented position by the orienting elements 4 in combination with the centering elements 17 and are secured against shifting in the plane of the receiving region 5.

Figure 3:
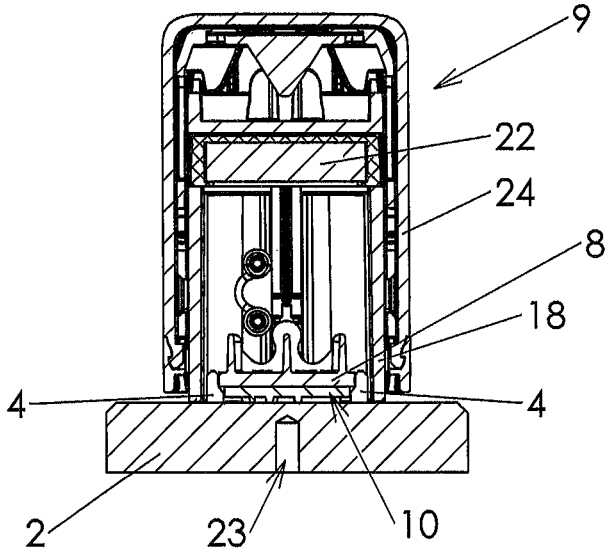
FIG. 3 shows a sectional view of a mounting device and a stamp in a position according to FIG. 2*d*.

The four orienting elements 4 shown in FIG. 1 do not only serve to guide and support an inserted stamp plate 7, but also guide a stamp 9 or its housing 18 intended for mounting the stamp plate 7 (cf. also FIG. 3).

Figure 2A:
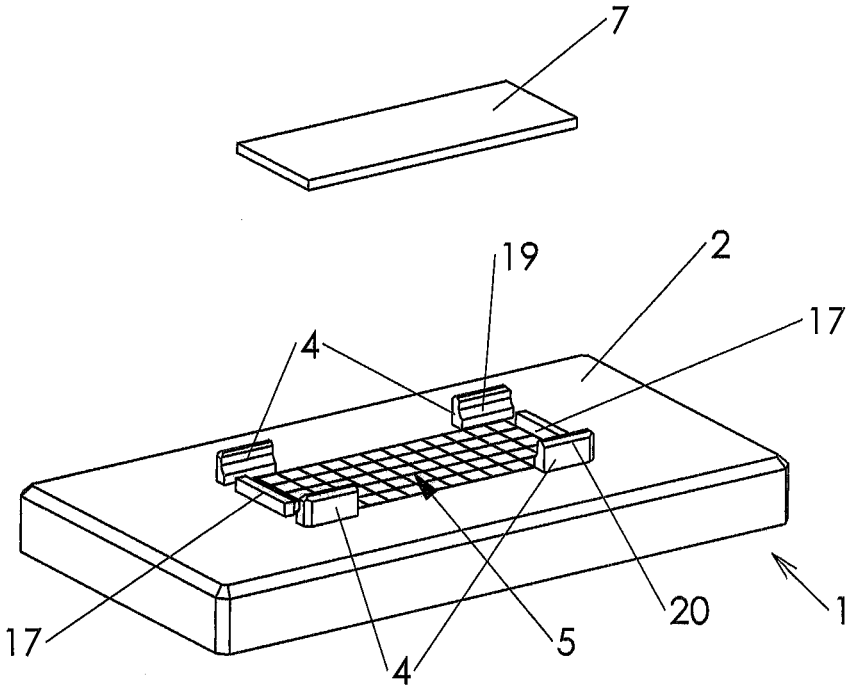
FIGS. 2*a*-2*d* show a time sequence of a use of the mounting device according to FIG. 1.

FIG. 2*a* shows the mounting device 1 according to FIG. 1 comprising a stamp plate 7 schematically arranged above it. The thickness of the stamp plate 7 is less than the height of the orienting elements 4, so that the orienting elements 4 project beyond the stamp plate 7 in an inserted position (cf. FIG. 2*b*). In comparison to the orienting elements 5, the height of the centering elements 17 approximately corresponds to the thickness of the stamp plate 7. All of the plate-shaped, upright orienting elements 4 have the same height and are perpendicular on the base 2. On an inside facing the receiving region 5, in a lower half which is closer to the base, they comprise plate guide surfaces 19 bevelled towards the inside. The thickness of the orienting elements 4 in a region above the plate guide surfaces 19 is smaller than below. In addition, the orienting elements 4 comprise bevelled housing guide surfaces 20 at least on the upper end on their outer side facing away from the receiving region 5. In this example, the centering elements 17 do not show any bevel.

As can further be seen in FIG. 2*a*, the base is formed by a comparably massive plate, preferably consisting of a metal. Due to the thus relatively high weight of the mounting device 1 as compared to a usual stamp 9, a good stability during use, i.e. during the mounting of the stamp plate is obtained. In addition, nub-like foots made of rubber or some similar material having a high friction can be provided on the bottom side (not shown) of the base 2, which prevent the base 2 or the mounting device 1 from shifting on the ground.

Figure 2B:
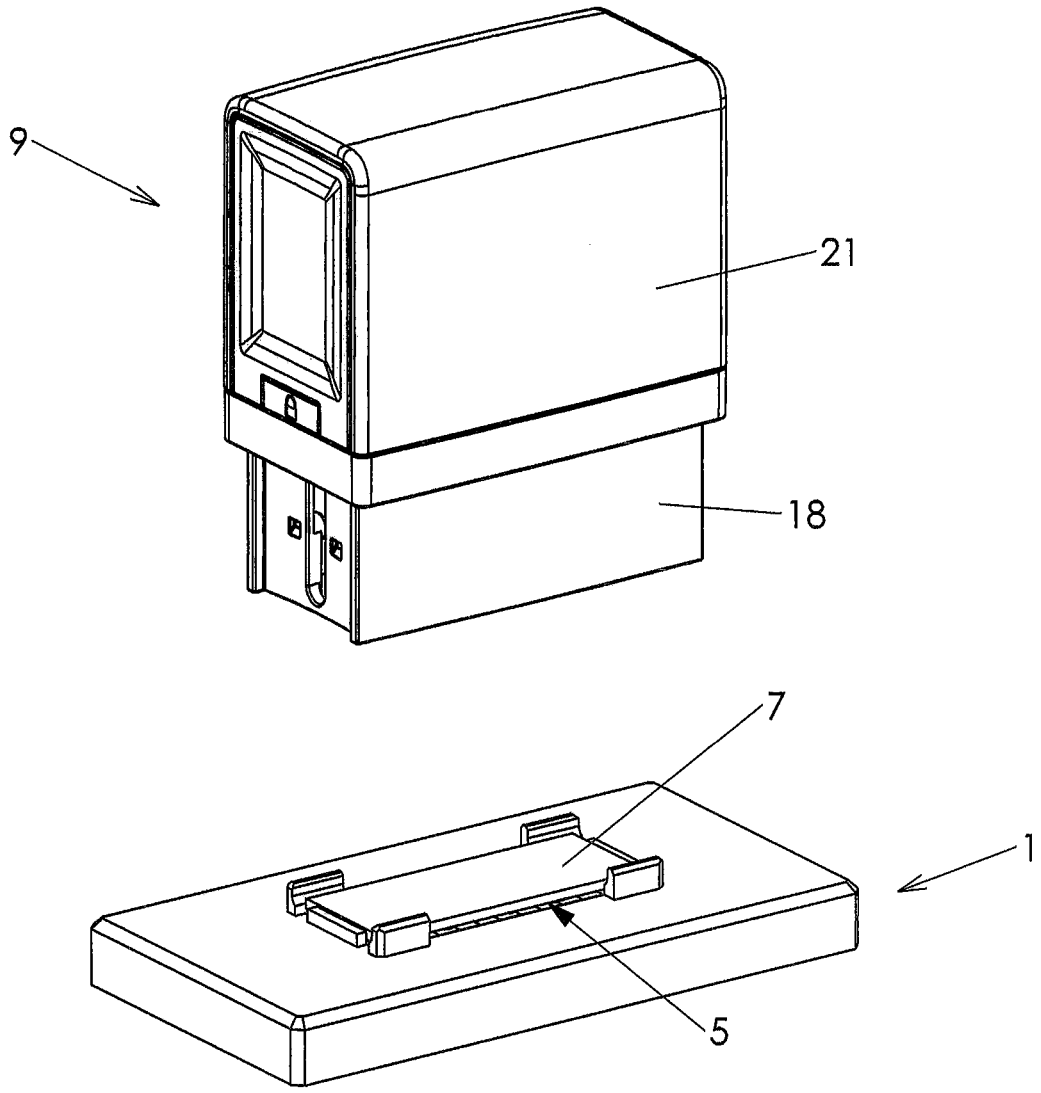

FIG. 2*b* shows the mounting device 1 according to FIG. 2*a* comprising the stamp plate 7 inserted in the receiving region 5. Schematically above, a stamp 9 is arranged in the form of a self-inking stamp 21 which has been well-known in terms of its function (cf. e.g. also EP 1 603 754 B1), the stamp plate carrier 8 (cf. FIG. 3) of the stamp 9 in this example not yet being provided with a stamp plate. When moving the stamp 9 towards the mounting device 1 the housing 18 of the stamp 9 is aligned along the orienting elements 4 relative to the base 2.

Figure 2C:
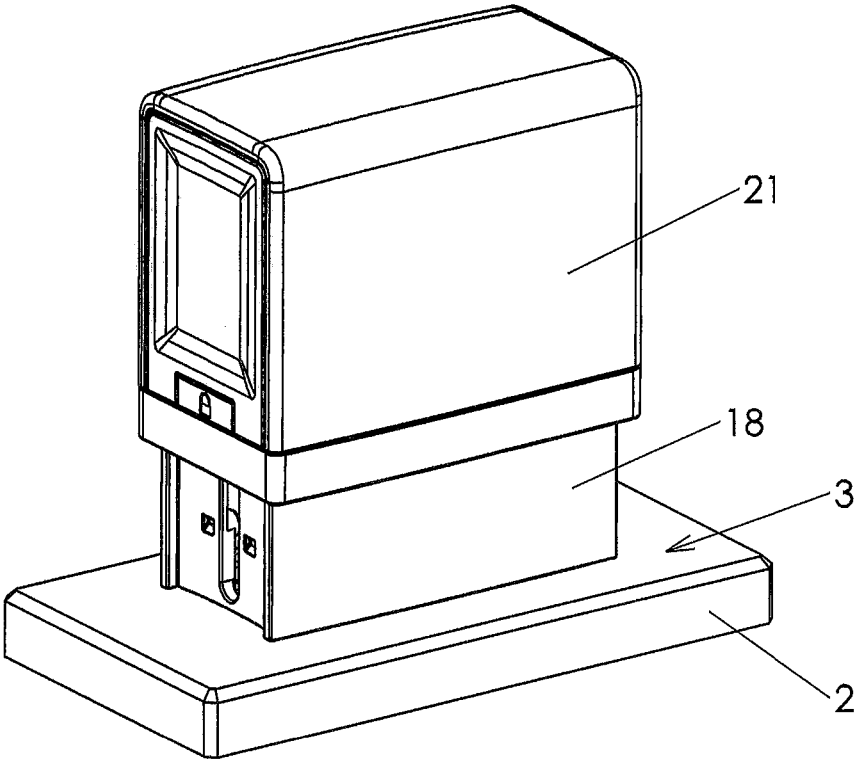

In the position of the stamp 9 on the mounting device 1 shown in FIG. 2*c*, the housing 18 is completely aligned and rests on the top side 3 of the base 2. Since it pertains to a self-inking stamp 21, in this position the stamp plate carrier 8 is still spaced apart from the stamp plate 7, and therefore it has not yet been aligned by the orienting elements 4 now arranged within the housing 18.

Figure 2D:
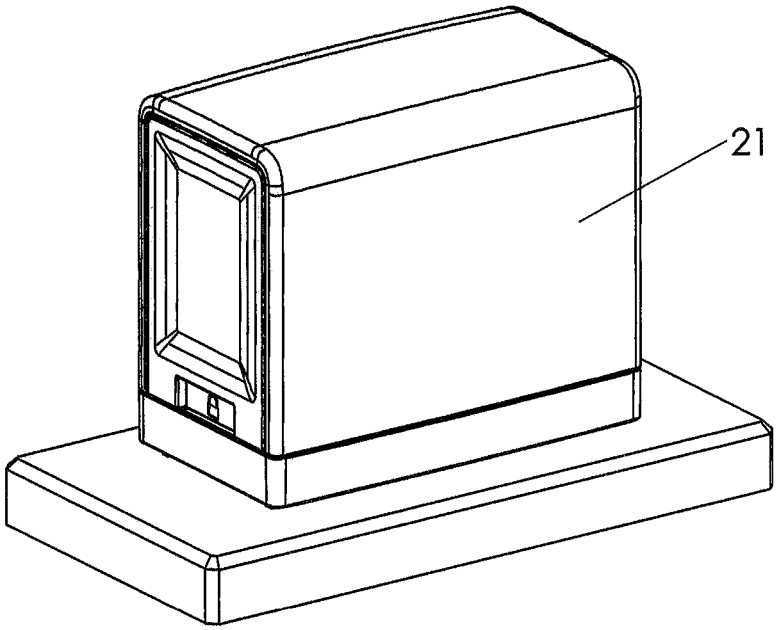

When actuating the self-inking stamp 21 according to FIG. 2*d* within the sense of producing a print, the stamp plate carrier 8 is turned in a manner known as such and moved against the support surface, i.e. in this case to base 2 of the mounting device 1 and thus to the stamp plate 7 arranged in the receiving region 5 (cf. FIG. 2*b*). In this process, the stamp plate carrier 8 is additionally aligned by the insides of the orienting elements 4, as soon as it has reached the height of the orienting elements 4. Thus, the stamp plate carrier 8 is aligned relative to the base 2 and the stamp plate 7, before e.g. an adhesive surface on the impression side 10 of the stamp plate carrier 8 comes into contact with a back side of the stamp plate 7 pointing upwards.

As soon as the position of a complete actuation of the stamp 9 has been reached, the stamp plate 7 may be pressed onto the stamp plate carrier 8 by means of the pressure exerted on the stamp 9 from above and be connected thereto, if for example a layer of a pressure-sensitive adhesive is applied to the stamp plate carrier 8 or possibly to the stamp plate 7. During the subsequent lifting of the stamp 9, the stamp plate carrier 8 carries the stamp plate 7 along and moves it for instance to a stamp pad 22 arranged in the self-inking stamp 21 in a manner known as such (cf. FIG. 3), so as to ink the printing plate for any future uses.

FIG. 3 shows a cross-section transversely to the longitudinal axis 12 (cf. FIG. 1) of the receiving region 5 through the mounting device 1 and a self-inking stamp 21 arranged thereon according to FIG. 2*d*. As can be seen from this cross-section, the orienting elements 4 are arranged between the housing 18 of the stamp 9 and its stamp plate carrier 8 accommodated in the housing 18 and thus align the stamp 9 from inside. A recess 23 comprising a screw thread can be seen on the bottom side of the base 2 of the mounting device 1. This allows to fix the mounting device 1 to a working surface, in particular by screwing it onto said surface.

Even if the preceding examples show a self-inking stamp, the mounting device described here may of course be used for any other type of stamps. For this, only the arrangement of the orienting elements would have to be adapted to the respective shape of the stamp plate carrier and/or possibly the stamp housing. Conceivable shapes of the receiving region not only include rectangular, plane shapes, but any shapes, for example, round, oval, square and even curved or other shapes deviating from a plane (e.g. in the case of stamps for applying prints on curved surfaces).

The invention claimed is:

1. A mounting device (1) for mounting a stamp plate (7) on a stamp plate carrier (8) arranged in a stamp housing (18), comprising a base (2), at least one orienting element (4) arranged on a top side (3) of the base (2), said at least one orienting element (4) delimiting a receiving region (5) for a stamp plate (7), the receiving region having dimensions corresponding approximately to those of an impression side (10) of the stamp plate carrier (8), and centering elements (17) for the stamp plate (7), which are arranged on the base (2) adjacent to and outside of the receiving region (5), the centering elements (17) having a centering element height above the top side of the base and the at least one orienting element (4) having an orienting element height above the top side of the base, wherein the centering element height is less than the orienting element height of the at least one orienting element (4).

2. The mounting device (1) according to claim 1, wherein the base (2) comprises at least two orienting elements (4) for the stamp plate (7).

3. The mounting device (1) according to claim 2, wherein the at least one orienting element (4) has, on an inner side of the at least one orienting element facing the receiving region (5), a plate guide surface (19) which is partially bevelled relative to an otherwise perpendicular course with respect to the top side (3) of the base (2).

4. The mounting device (1) according to claim 2, wherein the at least one orienting element (4) has a housing guide surface (20) extending partially upwards in a bevelled manner on an outer side of the at least one orienting element, said outer side facing away from the receiving region (5).

5. The mounting device (1) according to claim 2, wherein the base comprises at least four orienting elements for the stamp plate.

6. The mounting device (1) according to claim 1, wherein the orienting elements (4) are adapted to protrude in height beyond a stamp plate (7) inserted in the receiving region (5).

7. The mounting device (1) according to claim 1, wherein in an assembly position with a stamp (9), at least one orienting element (4) is arranged at least partially between the stamp housing (18) and the stamp plate carrier (8) of the stamp (9).

8. The mounting device (1) according to claim 1, wherein the centering element height of the centering elements (17) corresponds to about a stamp plate thickness of the stamp plate (7).

9. The mounting device (1) according to claim 1, wherein the base (2) comprises a recess in the receiving region (5).

10. The mounting device (1) according to claim 9, wherein a depth of the recess in the receiving region corresponds to about a print relief depth of a print relief of the stamp plate.

11. The mounting device (1) according to claim 1, wherein the receiving region (5) comprises orienting marks (6) for freely orienting the stamp plate (7).

12. The mounting device (1) according to claim 1, wherein the base is a plate like base.

13. The mounting device (1) according to claim 1, wherein in an assembly condition with a self-inking stamp at least one orienting element is arranged at least partially between the stamp housing and the stamp plate carrier of the stamp.

* * * * *